US005136519A

United States Patent [19]

Yonemitsu

[11] Patent Number: 5,136,519

[45] Date of Patent: Aug. 4, 1992

[54] TEXTILE COLOR DESIGN SIMULATING APPARATUS

[75] Inventor: Takashi Yonemitsu, Ishikawa, Japan

[73] Assignee: Ishizaka Shoji Co., Ltd., Ishikawa, Japan

[21] Appl. No.: 474,773

[22] PCT Filed: Jul. 20, 1988

[86] PCT No.: PCT/JP88/00728

§ 371 Date: Mar. 12, 1990

§ 102(e) Date: Mar. 12, 1990

[87] PCT Pub. No.: WO90/01196

PCT Pub. Date: Feb. 8, 1990

[51] Int. Cl.[5] ..... G06F 15/60; D06P 5/00

[52] U.S. Cl. ..... 364/470; 364/526; 356/402

[58] Field of Search ..... 364/470, 526, 521, 525, 364/900; 356/402; 358/76, 80; 101/DIG. 29

[56] References Cited

U.S. PATENT DOCUMENTS

| | | | |
|---|---|---|---|
| 3,601,589 | 8/1971 | McCarty | 364/526 |
| 4,349,279 | 9/1982 | Jung | 356/402 |
| 4,635,213 | 1/1987 | Murata et al. | 364/526 |
| 4,683,466 | 7/1987 | Holtey et al. | 364/900 |
| 4,829,455 | 5/1989 | Long et al. | 364/521 |
| 5,012,431 | 3/1991 | Stanziola | 364/526 |

*Primary Examiner*—Jerry Smith
*Assistant Examiner*—Paul Gordon
*Attorney, Agent, or Firm*—Bauer & Schaffer

[57] ABSTRACT

A table 10 is provided on which are registered a number of sets of color signals 11 which are formed by the combination of sets of an RGB signal 12 to be supplied to a color display 16 to display the same color, a YMC(Bk) signal 13 to be supplied to a color printer 6 and a reflectivity signal 14 of a corresponding color. Computers 31 and 32 are provided for computing dye recipes, wherein the reflectivity signal 14 of a color displayed on the color display 15 is retrieved from the table 10 and a recipe of dye necessary for reproducing the same color as that displayed on a textile is computed and then outputted.

3 Claims, 3 Drawing Sheets

TEXTILE COLOR DESIGN SIMULATING APPARATUS

TECHNICAL FIELD

This invention relates generally to color design simulating apparatus suitable for examining and determining a textile design and more particularly relates to an apparatus for obtaining a recipe of dyes necessary for dyeing a predetermined design.

BACKGROUND ART

As an apparatus for examining and determining a color design, there has been known a color design simulating apparatus having an original document reading apparatus such as a drum scanner or the like, a color display represented by a color CRT and a color printer, in which a color original document is read and displayed on the display and a color of a design displayed on the display is changed by operating keys and dials and is printed out by the printer as a sample, if necessary.

As is well known, the coloring of the color display is obtained by adjusting brightness of R (red), G (green) and B (blue) dots, whereas the coloring of the color printer is obtained by arrangements of dots of respective colors of Y (yellow), M (magenta) and C (cyan) or respective colors of Y, M, C and Bk (black) (the coloring is generally performed by the latter 4 colors, and in the following description, the combination of the former and latter colors is indicated as Y, M, C, (Bk)) in the coloring area of the unit which is made of, for example, $4\times4=16$ dots. Thus, the coloring principles thereof are different. Accordingly, in the above-described color design simulating apparatus, the color expressed on the color display and the color expressed by a sample printed-out by the color printer can not always be matched with ease. As one method for removing the above-described difficulty, Japanese Published Patent Gazette No. 52-16403 describes the following means in which a table formed by the combination of sets of R, G, B signals with a number of gradations and sets of Y. M, C, (Bk) signals, expressing the same colors as those of the R, G, B signals is stored in advance in a memory and a color display displays a color by utilizing the set of R, G, B signals stored in the table so that, when the corresponding color is printed, the Y, M, C, (Bk) signals forming the pair with the R, G, B signals are supplied to a printer.

On the other hand, dyeing computer color matching apparatus having a photoelectric colorimeter and a spectrophotometer are well known. These apparatus analyze color informations read out from color chips to output a recipe of dyes necessary for displaying the colors of the corresponding color chips on the basis of dye data registered in advance. When the operator mixes the dyes in accordance with this recipe, it is possible to reproduce the same color on the color chips on a textile.

Accordingly, in examining and determining the color design in the textile design in the prior art, the original document, which becomes a draft, is read-out by the color design simulating apparatus and is displayed by the display. Then, the color is changed on the display in various ways by operating a key and a dial and some kinds of suitable designs are printed out by the printer as samples. When the final design is determined by examining the sample, the color chip of color used in that design is printed out and the color chip is read out by the computer color matching apparatus, thereby the recipe of dyes being obtained.

However, according to the above-described prior art method, in order to obtain a recipe of dyes, the color displayed on the display of the color design simulating apparatus is temporarily printed-out as the color chip, and this color chip is read-out by the computer color matching apparatus to thereby form the recipe. Therefore, although the means described in Japanese Published Patent Gazette No. 52-16403 is employed, an external disturbance in the printing-out and reading operations is always unavoidable and the working process becomes cumbersome. Accordingly, an object of the present invention is to obtain a textile color design simulating apparatus which can eliminate such problems.

DISCLOSURE OF INVENTION

This invention relates to an electronic color design simulating apparatus which is provided with a color display 5, a color printer 6 and a processor 2 as shown in FIG. 1. The printer 6 may be of a thermal transfer type, a wire-dot impact type, an ink jet type or the like and can express gradations of respective colors by the striking number of dots in Y, M, C and (Bk) dots in a determined unit of coloring areas.

The apparatus of the invention is provided with a storage apparatus 4 in which there is registered a table 10 shown in FIG. 2. In the table 10, there is stored a color signal 11 which is formed, when a certain color is expressed, by making an RGB signal 12, formed of R, G and B values, supplied to the display apparatus 12, an YMC (Bk) signal 13, formed of Y, M, C and (Bk) values, supplied to the printer 6 and a reflectivity signal 14 of the corresponding color as one set. The reflectivity signal 14, herein, is formed of data group of reflectivities of colors to be expressed for respective lights of a plurality of wavelengths in the visible area.

The apparatus of the present invention is provided with means 31 and 32 which compute a dye recipe from the reflectivity signal 14. As these means, it is possible to employ means used in the prior-art computer color matching apparatus. These means can be realized by a computer program. The apparatus of the present invention is further provided with means for discriminating a color signal of a color presently displayed on the color display 5 from other color signal, means for searching the thus discriminated color signal, means for supplying a reflectivity signal of the color signal thus detected by the search to means which computes the recipe and means for displaying a computed result.

In the above-described apparatus, a color displayed on the display 5 is a color registered and is displayed by selecting one or a plurality of registered color signals 11 and supplying the RGB signal 12 thereof to the display 5. The selected color signal 11 is discriminated from other color signals by the above-mentioned discriminating means. For example, a flag is raised in an index area of the selected color signal or the selected color signal is transferred to a look-up table 20. The color to be displayed is changed by inputting direction and amount of changes with respect to, for example, hue, lightness and chroma saturation by dials or keyboard. The processor 2 cancels the original color signal in accordance with the inputted instruction and selects a new color signal.

When the color of the design is examined on the color display 5 as set forth above and a proper color is determined, the operator inputs a recipe print-out command. In response to this command, the above search means searches the color signal in which the flag is raised or the color signal on the look-up table 20. The reflectivity signal 14 of the color signal thus detected by the search is inputted to means 31 and 32 which compute the above-described recipe and a dye recipe necessary for reproducing the corresponding color is printed out by the printer 6.

When on the other hand a hard copy of the design displayed on the display 5 is needed, the YMC(Bk) signal 13 of the color displayed on the display 5 is supplied to the printer 6 by supplying a print command to the color printer 6. Thus, the color matching between the color printed and the color displayed on the display 5 can be assured.

Figure 1:
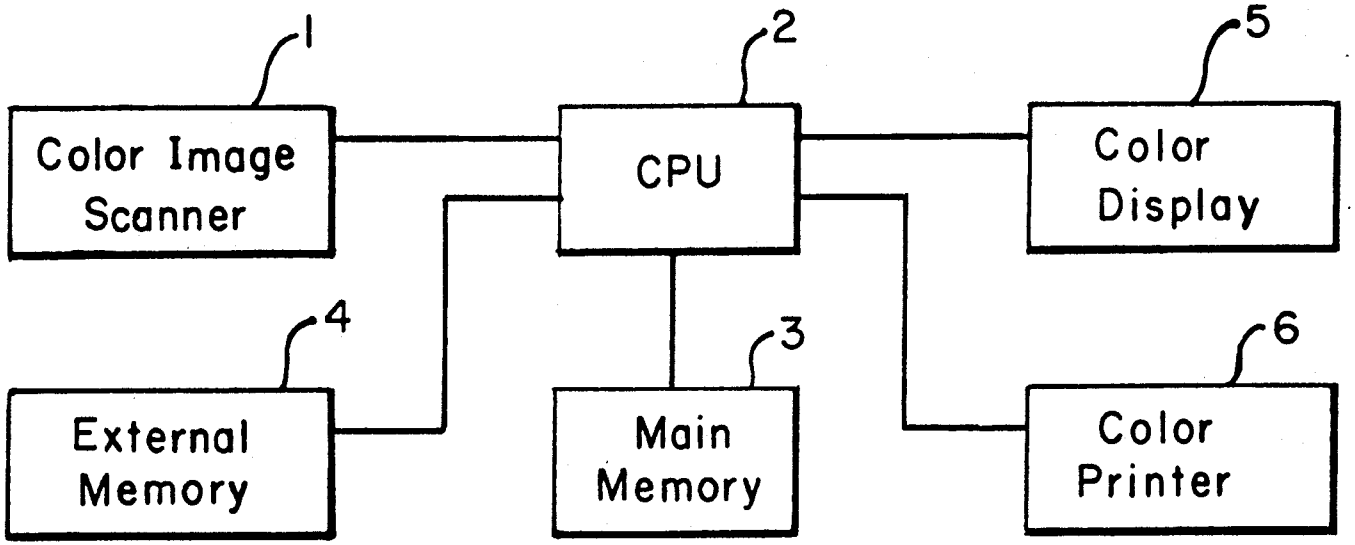
FIG. 1 is a block diagram showing an arrangement of apparatus of this invention.

In the drawings, reference numeral 10 designates a table registered in an external memory, 11 a color signal registered in the table, 12 an RGB signal supplied to a display, 13 a YMC(Bk) signal supplied to a printer, 14 a reflectivity signal, 20 a look-up table of a main memory, 22, 23 and 24 copy regions of the RGB signal, YMC(Bk) signal and reflectivity signal, 25 a region for a flag indicating a used state, 31 an absolute isochromatic recipe computing routine, and 32 a conditional isochromatic computing routine.

BEST MODE FOR CARRYING OUT THE INVENTION

FIG. 1 is a block diagram showing a hardware arrangement of apparatus of this invention, wherein reference numeral 1 designates a color image scanner, 2 a processor, 3 a main memory, 4 an external memory, 5 a color display and 6 a color printer.

The table 10 having a number of color signals 11 is registered in the external memory 4. One color signal is formed of a signal group formed of three kinds of signals of the RGB signal 12, the YMC(Bk) signal 13 and the reflectivity signal 14. The RGB signal 12 is composed of luminance data of red R, green G and blue B to be fed to the color display 5, and the YMC(Bk) signal 13 is composed of dot number data of yellow Y, magenta M, cyan C and black Bk to be supplied to the coloring area (n dots) of one unit of the color printer 6 and code data D of its location pattern (dither pattern). The reflectivity signal 14 is formed of data of reflectivities $\eta_1$, $\eta_2$, . . . , $\eta_{16}$ of corresponding colors relative to light rays having 16 wavelengths selected from wavelength regions (400 to 700 nm) of visible light rays by an equal interval. The code data D of dither pattern may not always be provided. If it is arranged that dither patterns of several kinds are selected by specifying the code D, then it becomes possible to express colors having gradations finer than those restricted by the dot number in the unit coloring area.

The RGB signal 12, the YMC(Bk) signal 13 and the reflectivity signal 14 of the respective colors are registered in the table 10 as follows.

Figure 2:
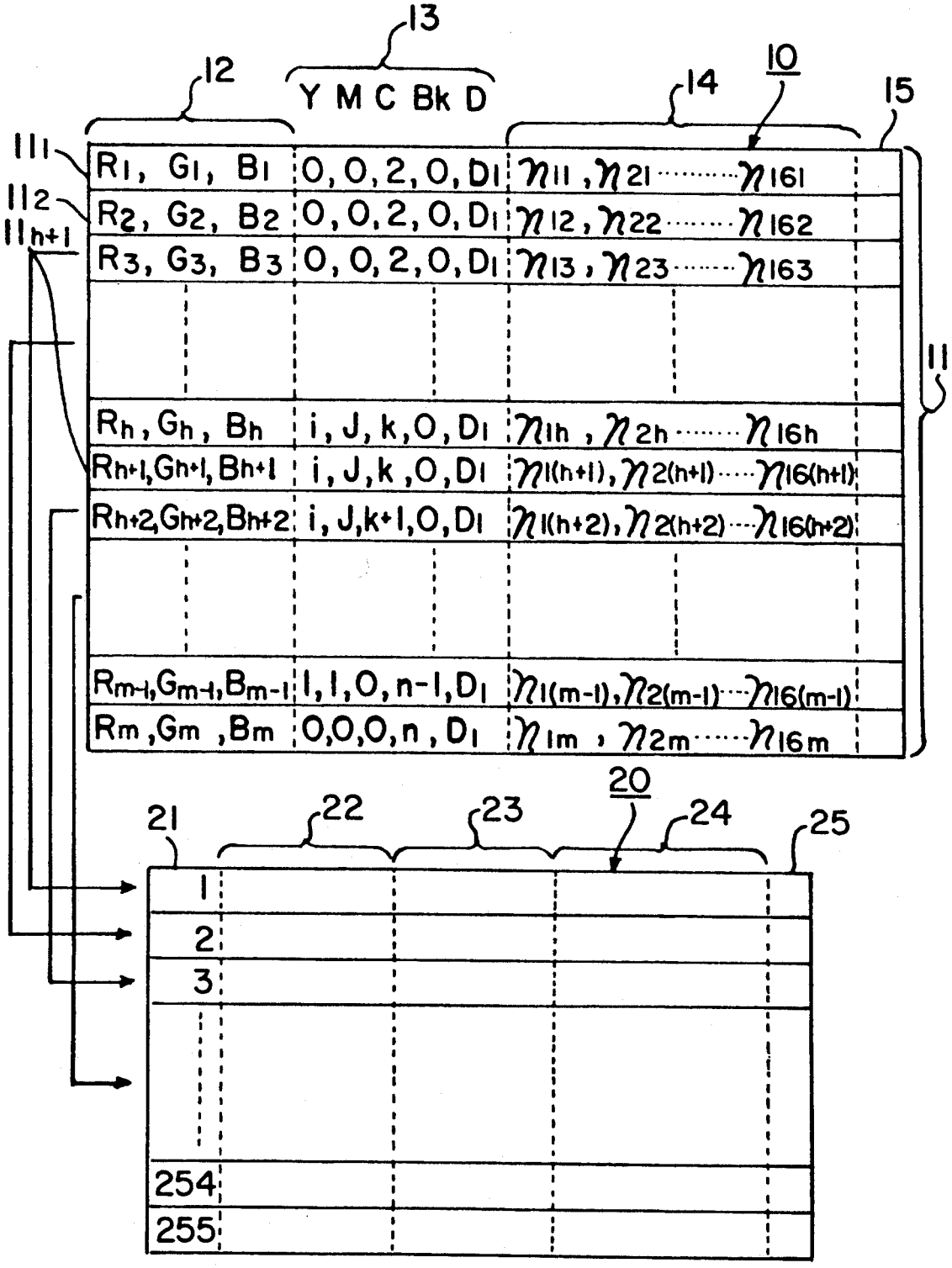
FIG. 2 is a diagram showing a table registered in a storage apparatus and FIG. 3 is a diagram showing an example of a flow chart provided when this invention is realized by a program.

If the dot number of the unit coloring area set, for example, in the printer 6 is determined as n ($4\times4=16$ dots in one practical example), the gradations of the YMC(Bk) signal 13 are expressed by the combination of $n+1$ gradations of concentration gradation of primary colors of yellow Y, magenta M and cyan C including white (without striking of the color point). Therefore, all the combinations $(n+1)^3$ thereof is registered in the table 10, and R, G and B values corresponding to respective ones are derived from the relationship between three primary colors in light and three primary colors in color. Then, the R, G and B values are temporarily registered in the table 10 as the RGB signals 12 corresponding to the respective YMC(Bk) signals 13. The gradations of the respective colors, Y, M, C and (Bk) that can be printed by the printer 6, are determined by the dot impact number within the unit coloring area so that the Y, M, C and (Bk) values are registered in the table 10 as integral values of 0 to n. In this embodiment, dots in which all dots of Y, M and C are struck in a superimposed fashion are replaced with the Bk dots and then registered. Then, the data registered are read-out from the table and color chips corresponding to the respective color signals 11 are printed by the printer 6, whereby the temporarily registered RGB signal 12 is called back and the color is displayed on the display 5. Thereafter, the color displayed is compared with the corresponding color chips printed out by the printer 6. If a color difference therebetween is discovered, the color displayed on the display 5 is corrected by the manual operation until the color difference therebetween is removed. Accordingly, when the color corrected is displayed, the R, G and B values supplied to the display 5 are replaced with the R, G and B values temporarily registered. The correcting work in which the R, G and B values are corrected by comparing the displayed color on the display 5 and the color chip need not be carried out on all color signals registered in the table 10 but it is carried out only on the corresponding color signal by properly selecting the representing color signal. While, data registration and data correction may be carried out on other color signals by a proper interpolation equation (e.g., linear interpolation). If the results of printing-process demonstrates that a color difference between adjacent color chips is too large, a color signal having a different dither pattern (a color signal $11_{h+1}$ of, for example, FIG. 2) is inserted into the adjacent color chips, whereby colors of m ($m \geqq (n+1)^3$) kinds whose number is sufficient can be expressed. In the next process, the reflectivities $\eta_1$ to $\eta_{16}$ of the above-described color chips relative to light rays of the 16 wavelengths are measured by using a spectrophotometer, and the measured values are registered as the reflectivity signals 14 of the corresponding colors. By the above-described operations, the table 10 is registered in the external memory 4.

In the external memory 4, there are registered basic data of dyes to be used and light source data in addition to the table 10. Data to be registered as the data are described in detail in [KOGYO SOKUSYOKUGAKU] edited and published by, for example, SENISHA (published on Jun. 15, 1969).

In the apparatus of the illustrated embodiment, the main memory 3 is provided with the look-up table 20 for the color signal 11, and the design is determined as follows.

An original document, which becomes a draft, is read by the color image scanner 1, and frequencies of appearance of the color signal 11 having R, G and B values most approximate to the R, G and B values calculated at every dot are counted in its count areas 15. Of the color signals to be counted, the approximate colors are combined as one color signal, and these color signals are selected and copied on the look-up table 20. Reference numeral 22 designates a copy area for the RGB signal 12, 23 a copy area for the YMC(Bk) signal 13, 24 a copy area for the reflectivity signal 14. and 25 an area for a flag which indicates whether or not a status of a signal at that row is used practically. By specifying the address 21 of the look-up table 20, the RGB signal within this address is supplied to the color display 5. The display color of the color display 5 is changed by reading a new color signal from the table 10 or by copying the same to the look-up table 20 newly or instead of the original color signal.

Figure 3:
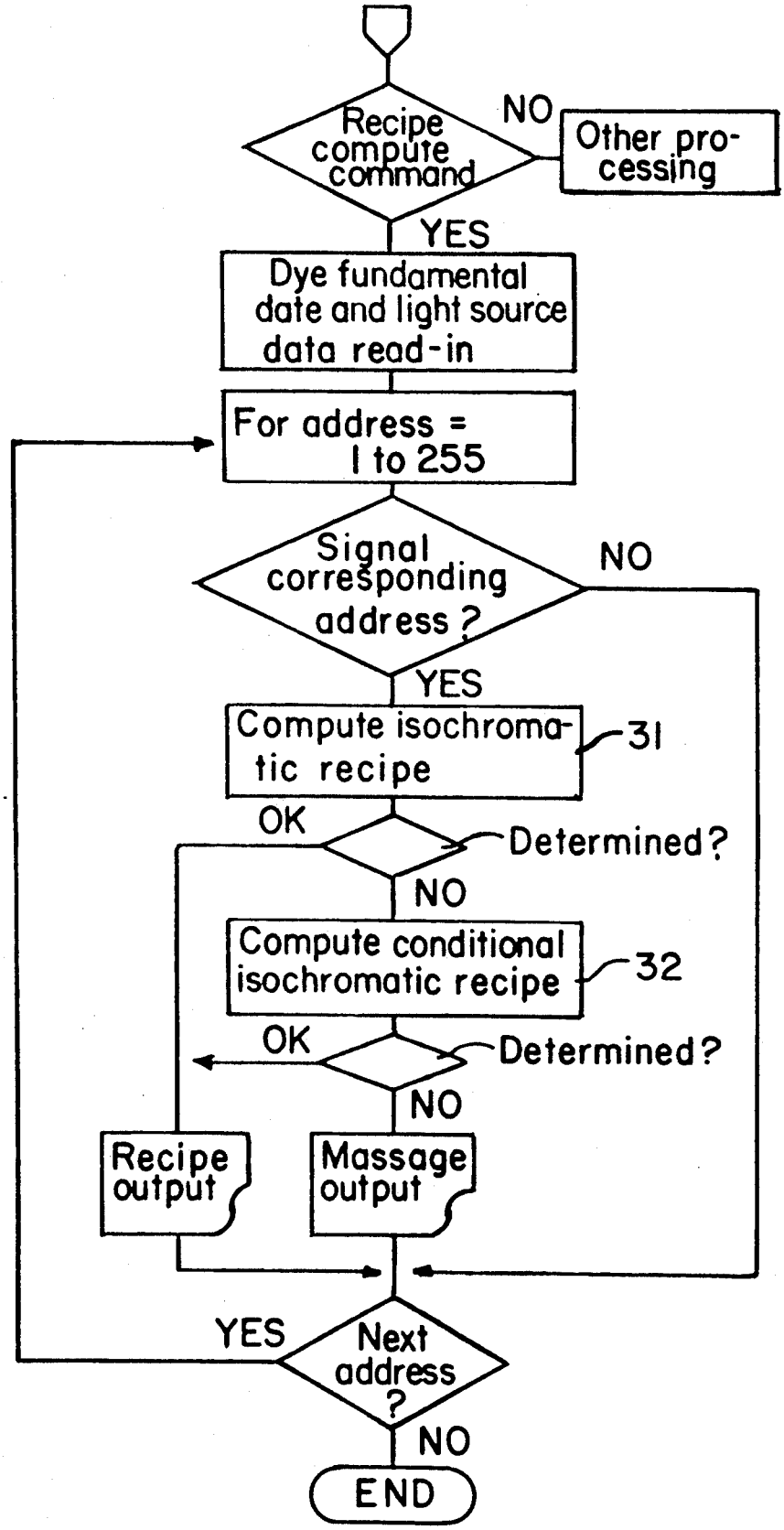

As described above, the color of the design displayed on the color display 5 is examined. When the design is finally determined, the forming of the dye recipe is instructed. This instruction is performed by the key operation, and after this instruction, the dye basic data and the light source data are written in the main memory 3 from the external memory 4. In accordance with the procedure shown in FIG. 3, the processor 2 searches the color signals copied to the look-up table 20 in sequence, and computes a dye recipe with respect to the signal currently used by utilizing its reflectivity signal 14 at recipe computing routines 31 and 32. Initially, it is tried to produce a recipe which satisfies an absolute isochromatic condition at the absolute isochromatic recipe computing routine 31. If a satisfactory recipe is not obtained, a recipe which satisfies a conditional isochromatic state is formed at the conditional isochromatic computing routine 32. The computing procedures of these computing routines 31 and 32 may be the same as those employed in the prior-art computer color matching apparatus, and are described in detail in the above-described [KOGYO SOKUSYOKUGAKU]. The thus obtained recipe is printed-out by the printer 6. If the recipe, which satisfies the conditional isochromatic state, is not obtained, a message of computation impossible is produced and the next color signal is computed. As described above, all dye recipes necessary for expressing the colors displayed on the color display 5 on the textile can be obtained immediately.

I claim:

1. In a color design simulating apparatus having a color display (5), a color printer (6), a storage apparatus (4) in which a number of sets of color signals (11) for displaying colors on these apparatus are registered and a processor (2) for processing said color signals, a textile color design simulating apparatus in which one set of color signal (11) corresponding to a certain color is formed of a signal group including an RGB signal (12) to be supplied to said color display (5), a YMC or YMC(Bk) signal (13) to be supplied to said color printer (6) and a reflectivity signal (14) of said corresponding color, said reflectivity signal (14) indicates a reflectivity of said corresponding color relative to light rays of a plurality of wavelengths in a visible light region, comprising:

means (31) and (32) for computing dye recipes from said reflectivity signal;

means for discriminating a color signal of color displayed on said color display (5) from other color signals;

means for searching the color signal thus discriminated;

means for supplying the reflectivity signal of said color signal detected by said search to said means for computing said dye recipes; and means for displaying computed results.

2. In a color design simulating apparatus having a color display (5), a color printer (6), a storage apparatus (4) in which a number of sets of color signals (11) for displaying colors on these apparatus are registered and a processor (12) for processing said color signals, a textile color design simulating apparatus in which one set of color signal (11) corresponding to a certain color is formed of a signal group including an RGB signal (12) to be supplied to said color display (5), a YMC or YMC(Bk) signal (13) to be supplied to said color printer (6) and a reflectivity signal (14) of said corresponding color and said reflectivity signal (14) indicates a reflectivity of said corresponding color relative to light rays of a plurality of wavelengths in a visible light region, comprising:

means (31) and (32) for computing dye recipes from said reflectivity signal, wherein a reflectivity signal corresponding to a color signal of a color displayed on said color display (5) is read-out on the basis of a predetermined command and a dye recipe is computed by using said reflectivity signal and dye data.

3. In a method for mixing dyes in a textile color design utilizing a color design simulating apparatus having a color display (5), a color printer (6), a storage apparatus (4) in which a number of sets of color signals (11) for displaying colors on these apparatus are registered and a processor (12) for processing said color signal, comprising the steps of:

registering a reflectivity signal (14) of a color displayed by said color signal in response to respective sets of color signals (11) including an RGB signal (12) to be supplied to said color display (5) and a YMC or YMCBk signal (13) to be supplied to said color printer (6);

forming said reflectivity signal (14) by reflection data of corresponding colors relative to light rays of a plurality of wavelengths in a visible light region, whereby the reflectivity signal registered in response to a color signal of a color displayed on said color display (5) is read-out on the basis of a predetermined command; and computing a dye recipe by using said reflectivity signal and said dye data.

* * * * *